United States Patent [19]

Schulz et al.

[11] 4,058,693

[45] Nov. 15, 1977

[54] ELECTRIC SNAP-ACTION SWITCH

[75] Inventors: Siegfried Schulz, Wuppertal; Karl G. Eicker, Remscheid, all of Germany; August Reinke, Radevormwald

[73] Assignee: K. A. Schmersal & Co. Schaltgeratefabrik, Wuppertal-Barmen, Germany

[21] Appl. No.: 615,632

[22] Filed: Sept. 22, 1975

[30] Foreign Application Priority Data

Sept. 26, 1974 Germany ..... 2445957

[51] Int. Cl.[2] ..... H01H 13/28

[52] U.S. Cl. ..... 200/67 F

[58] Field of Search ..... 206/67 F, 67 B; 335/205

[56] References Cited

U.S. PATENT DOCUMENTS

| | | | |
|---|---|---|---|
| 2,598,556 | 5/1952 | Judson | 335/205 |
| 3,361,999 | 1/1968 | Leinauer et al. | 200/67 F |

FOREIGN PATENT DOCUMENTS

| | | | |
|---|---|---|---|
| 1,911,104 | 3/1969 | Germany | 280/67 F |

*Primary Examiner*—David Smith, Jr.
*Attorney, Agent, or Firm*—H. Dale Palmatier

[57] ABSTRACT

A snap-action switch having a housing, a push button and return springs therefor, a pair of contact assemblies and a pair of contact bridges between the contact assemblies, a jump member to alternately move the contact bridges against and away from the contact assemblies, a single stationary magnet on the housing, the jump member including a soft iron leg or plate to engage and be retained by the magnet, and the jump member also including a soft iron armature or plate movable with respect to the leg of the jump member toward and away from the magnet, and a bias spring alternately bearing at one end against the push button and jump member and alternately bearing at the other end through a thrust member or plate to the soft iron armature and the push button.

9 Claims, 10 Drawing Figures

ELECTRIC SNAP-ACTION SWITCH

Figure 1:
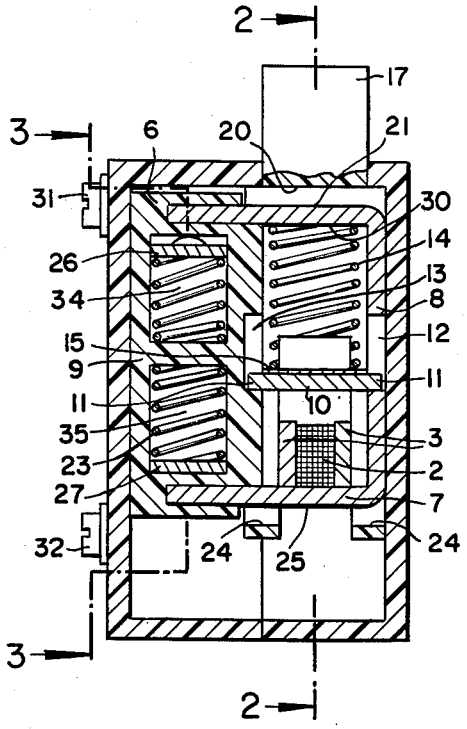

The invention relates to an electric snap-action switch.

German Offenlegungsschrift No. 1,911,104 describes an electric snap action switch in which the contact unit is connected to a jump member held in the extreme positions of the switch by means of a retention magnet/retention plate system with a predetermined force, which jump member is positively actuable by a push rod. Between push rod and jump member there is arranged a system of pre-tensioned springs which, after the retention system has been separated by the push rod, accelerates the jump member towards the other extreme position of the switch. The switch also has a system of return springs acting directly upon the push rod. In a switch of this kind, the retention-type magnet/plate system, which will hereinafter be referred to as "retention system" for short, has the purpose of keeping the contact pressure practically constant in the extreme positions of the switch, until the snap action occurs; any other type of retention system with a similar force path characteristic can, if desired, be used.

The retention system of the snap action switch just described comprises two permanent magnets, whilst the moving jump member carries an iron pin which comes to rest against the one or the other of the magnets. The system of pre-tensioned springs comprises two spiral springs arranged either side of the pin and compressed between push rod and jump member. If the push rod is actuated then the compression of one of the springs is increased; however, the force stored in it is not adequate to push the iron pin away from the magnet concerned. The switching occurs only when the push rod presses directly on the jump member and thus positively activates this. Switching would also occur in this case even if one of the springs in the pre-tensioned spring system breaks. Whilst the push rod is operated in one direction manually or by a machine part or the like, a system of return springs ensures that the return switching is effected positively. The return spring in the known switch acts directly upon the push rod, that is to say, it does not act via the jump member.

A design in which a system of two springs acts both to tension the jump member and also to return the push rod against the latter, is described in German Auslegesschrift No. 1,190,088. In one switching position, the forces of the two springs act together, whereas in the other switching position they are in opposition. This means that the springs are to be carefully balanced with respect to one another, and this increases manufacturing costs. On the other hand, the retention system of this switch has a single permanent magnet which is arranged on the moving jump member whereas two retention plates are fixed.

It is the object of the present invention to provide a snap action switch of the type mentioned initially, that is, in which the springs which bias the jump member on the one hand and for restoring the push rod on the other are separated functionally from one another, which also permits cheaper production with small external dimensions. Furthermore, it must also be possible to provide a considerable clearance of the push rod after the switching has occurred.

This object is achieved, according to the present invention, and is characterised in that there is installed in the switch housing a single retention magnet against which, in each extreme position of the switch, there lies a retention plate connected to the jump member, in that the bias spring system comprises a single pre-tensioned spring acting between the face of one of the retention plates, this face being remote from the retention magnet, in that a stop is formed in the jump member, and in that the push rod has on each side of the springs a face section which enters, in the one or the other switching direction, past the stop or the one retention plate respectively, into operative connection, wherein the distance of the face sections from the ends of the spring is less than the actuation path of the push rod up to the point at which the retention system is separated.

The use of a single retention magnet reduces costs and dimensions of the switch. The pre-tensioned spring system which comprises two springs in the known switch of like design, is reduced to a single pre-tensioned spring which is effective in both switching directions. Despite this, positive separation of function is ensured here too.

A switch embodying the invention is capable of being built of extremely small dimensions. Despite this, a clearance stroke of the push rod which is greater than the jump path of the jump member can be attained, if, as provided in further development of the invention, the retentive plate having the initially tensioned spring stop is guided in restricted movement relative to the jump member.

A compact type of construction is also obtained as a result of the pre-tensioned spring acting against the retention plate through a thrust piece and lying in one axis with the retention element. In this it is advantageous, but not absolutely essential, to provide not just a single spring, which engages behind the push rod, for restoring or returning this, as is the case in the known jump switch of the same kind, but to divide this spring into two parallel springs which engage at the sides of the push rod. This enables these springs to be arranged next to or above the contact system which is to be actuated by the jump member.

Further features of a switch embodying the invention are defined in the subsequent patent claims.

Figure 2:
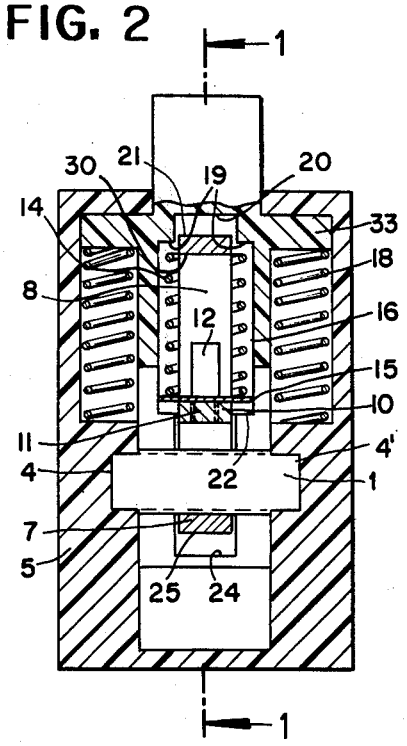
Figure 3:
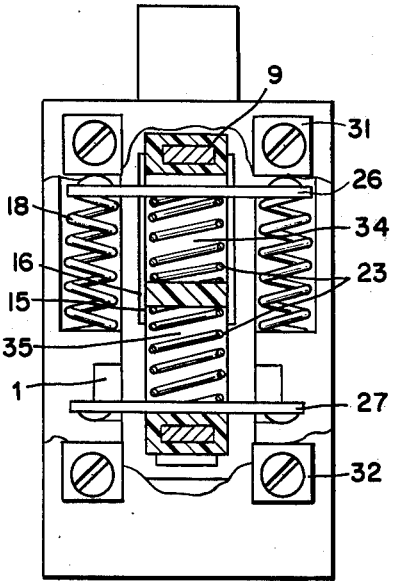
Figure 8:
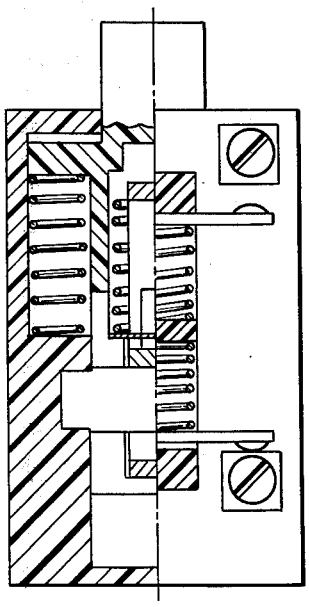
Figure 9:
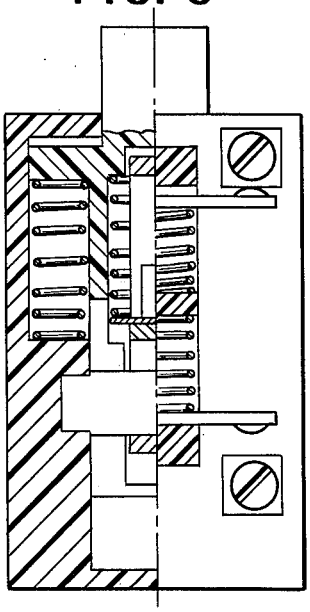
Figure 10:
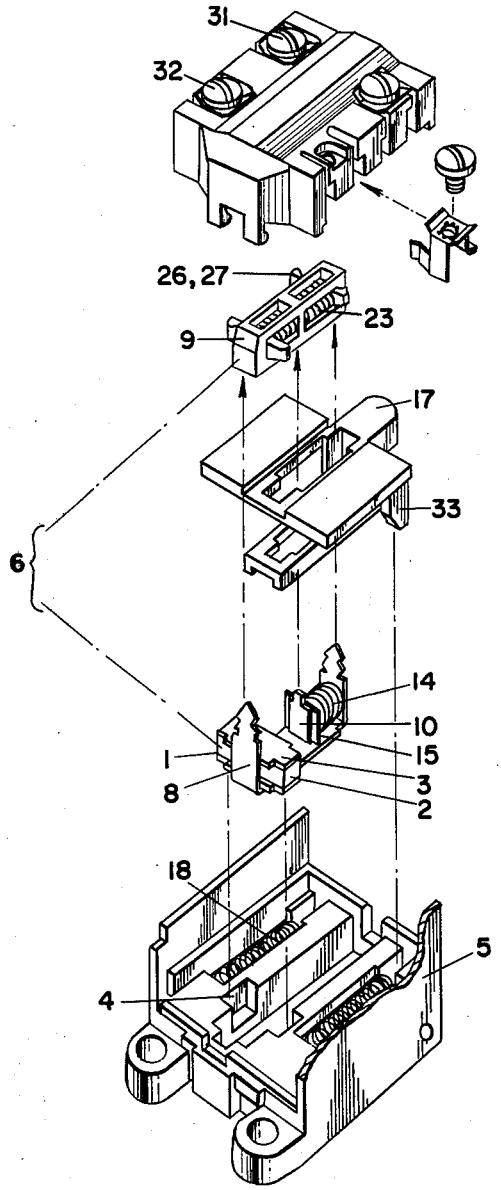

A preferred embodiment of the invention will now be described with reference to the accompanying drawings of which:

FIG. 1 is a section of the embodiment along line 1—1 of FIG. 2,

FIG. 2 is a longitudinal section of the embodiment along line 2—2 of FIG. 1, FIG. 3 is a longitudinal section of the embodiment along line 3—3 of FIG. 1, FIGS. 4–9 show the positions of the individual parts of the embodiment in successive settings during an actuation of the switch, the left-hand half of each Figure corresponding to FIG. 2 and the right-hand half of each Figure corresponding to FIG. 3, and finally FIG. 10 is a perspective exploded view of the embodiment approximately full size.

The components of the switch are accommodated in a housing 5 made of electrically insulating material. A push rod 17 projects from one end face of the housing 5. FIGS. 1 to 9 are schematic in so far as holes for securing the switch have been omitted and the terminals 31, 32 are only shown for the sake of completeness and they do not represent any particular form of terminal. Those components also are illustrated in FIG. 10.

A retention element 1 is held firmly in the housing 5 in recesses 4, 4'. The element 1 consists of a ceramic permanent magnet 2 with pole plates 3, and is of a form known per se in switches having a magnetic retention element. A jump member 6 is guided for movement in a longitudinal direction inside the housing 5. The member 6 consists basically of a "U"-shaped bracket 8, the free ends of whose limbs are embedded in a contact unit 9 of electrically insulating material. The bracket 8 is of soft iron or mild steel. The base of the bracket 8 has an elongated slot 12 there being a similar slot 13 in the contact unit lying mirror-inverted opposite to slot 12. Guide projections 11 of a second retention-plate 10 extend into the slots 12, 13.

The first retention plate is formed by the limb 7 of the bracket 8, as will be explained below. The retention plate 10 is therefore movable in a longitudinal direction relative to the jump member, and this movement is restricted by the length of the slots 12, 13.

A bias spring 14 acts between a thrust piece 15 positioned against that side of the retention plate 10 remote from the retention element 1 and the upper limb of the bracket 8, that is, against the surface referenced 30 in FIGS. 1 and 2. However, the dimensions are selected such that the diameter of the spring 14 is greater than the width of the bracket 8 of the retention plate 10, respectively as can be seen from FIG. 2. The spring therefore projects radially beyond both sides of the bracket 8.

A push rod 17, inserted in the housing 5, is also movable in a longitudinal direction. Directly beneath the opening for the rod 17 in the upper wall of the housing the rod has lateral, extension pieces 33, against which returning springs 18 act. The push rod 17 also has four working faces extending at right angles to its direction of movement which are important for the functioning of the switch. The faces 20 and 24, respectively, are in operative connection with the faces 21 and 25, of the bracket 8, while the faces 19 and 22 act, respectively, against those parts of the spring 14 which project laterally beyond the bracket, and against the thrust piece 15 which also projects laterally to the same extent. The push rod 17 has recesses 16 between the faces 19 and 22.

The working faces 20 and 25 and also the faces 21 and 25 co-operating with them may also be arranged in positions on the push rod or the jump member other than those shown in FIGS. 2 and 3 without impairing their operation characteristics.

Finally, the contact unit 9 has two recesses 34, 35 in which electrically conductive contact bridges 26 and 27 respectively are guided. Contact springs 23 press the bridges apart to their outer extreme position in each case. Co-operating with contact bridge 26 are two contact assemblies 31 whilst two further contact assemblies 32 co-operate with contact bridge 27. The arrangement is such that bridge 26 normally connects together electrically the contact assemblies 31 whilst bridge 27 is normally out of contact with assemblies 32, i.e. the latter are not joined together electrically. Other arrangements of contact assemblies are, of course, possible.

The method of operation is described below with reference to FIGS. 4 to 9.

Figure 4:
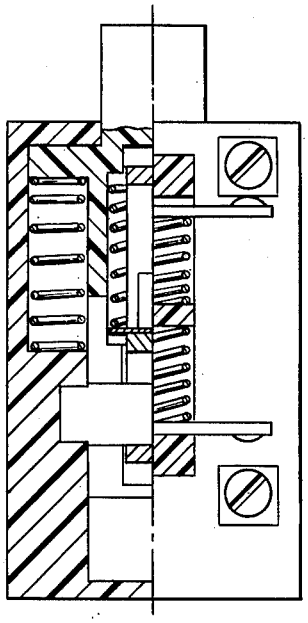
Figure 5:
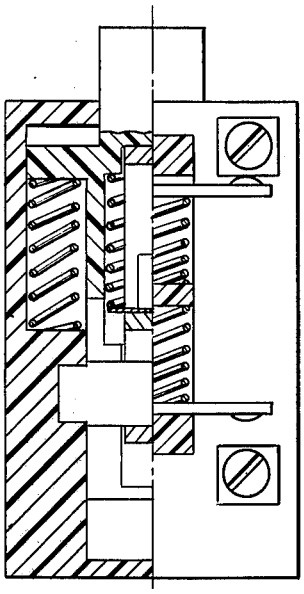

FIG. 4 shows the normal, at rest position of the switch, in which the push rod 17 lies in its upper extreme position in which it is shown in FIGS. 1 to 3 also. The bridge 26 is in contact with assemblies 31. The bracket 8 with its limb 7 acting as first retention plate lies attracted to the retention element, held by magnetic forces. The pretensioned spring is stressed between the second retention plate 10 and the free, second limb of the bracket 8. Under the action of the magnetic force the spring 23 is sufficiently strongly compressed for there to be an adequate contact pressure between bridge contact 27 and contact assemblies 32.

Figure 6:
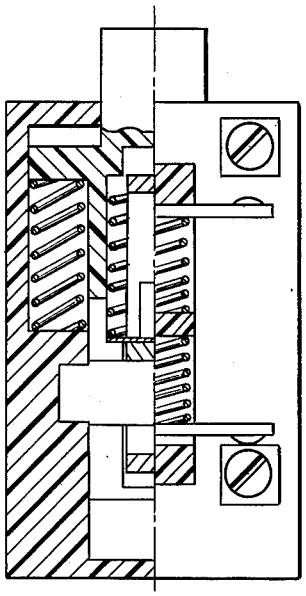

If the push rod 17 is now pushed into the housing 5, then the faces 19 of the push rod is first to come into contact with the pre-tensioned spring 14, and compresses it. However, the force stored as a result is not sufficient to move the jump member against the action of the retention element 1. Movement of the jump member occurs only when the face 20 of the push rod contacts the face 21 of the bracket 8 (FIG. 5) and this requires further movement of rod 17. A positive connection then exists between the push rod 17 and the jump member. As soon as the force acting upon the push rod becomes greater than the retaining force of the retention element 1 which acts upon the bracket limb 7, the latter snaps away from the retention element 1. Due to the pre-tensioned spring 14 which is now compressed, this spring acts through the thrust piece 15 on the second retention plate 10, which in turn connects via its projections 11 positively with the jump member. Consequently, the jump member is accelerated by the force stored in the pre-tensioned spring 14 and snaps forward until the second moving retention plate 10 lies adjacent to the retention element 1 (FIG. 6). The spacing between the faces 19/22 of the push rod is such as to ensure that the face 22 does not hinder this snap action. The same applies to the spacing between the faces 20/24 of the push rod which is in any case larger than the first mentioned spacing.

During the snap action the upper end of the contact unit 9 carries the upper contact bridge 26 downwardly and the latter moves away from contacts 31, whilst the lower contact bridge 27 connects together electrically the contact assemblies 32.

The path of the jump member 6 from the moment of connecting together the contact assemblies 32 until the extreme position is reached ensures effective electrical closure despite a degree of burn-off of the contacts of the assemblies. Together with the contact opening width of the bridge 26, it is determined by the jumping path of the jump member and this in turn corresponds to the distance of the retention plate 10 or 7 from the retention element. This jumping path may be selected freely within certain limits, which are given by the forces and paths available. Thus in the illustrated embodiment of the switch a relatively large contact opening width and good electrical contact despite burn-off may be achieved despite small dimensions.

Figure 7:
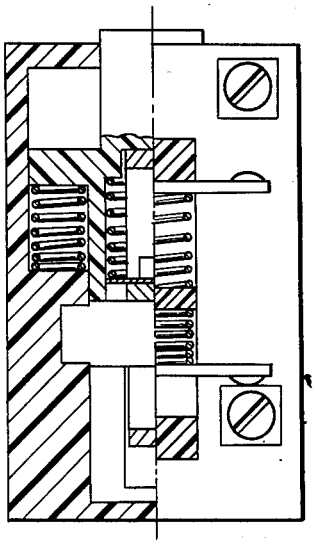

FIG. 7 shows that in a further movement of the push rod 17 inwards, the contact bridge 26, moves even further away from assemblies 31, and the burn-off certainty, contact bridge 27 is further increased, and that the spring 14 is again engaged by the push-rod face 19 and pre-tensioned, while the face 20 of the push rod again lies adjacent to the face 21 of the bracket 8. However, since the second retention plate may be moved to the right to bracket 8 or contact unit 9, it does not hinder this subsequent movement of the push rod, the so-called lagging or lost motion stroke.

If the force acting upon the push rod 17 is removed, then the return springs 18 push it in the direction of its first position. As a result of this the spring 14 relaxes again until it is trapped between the second retention plate 10 and the face 30 of the bracket. Shortly afterwards the face 22 of the push rod comes into contact with the lower end of the spring 14 (through the thrust piece 15), and after another short return travel path the push rod face 24 contacts the bracket face 25 (FIG. 8). The release of the tensioning function is effected analogously as described above for the reverse switching path.

Since a switch embodying the invention has a small differential lift and the force and path ratios during the jumping on the return movement should correspond to those during the forward movement of the push rod, it is necessary that, at the beginning of the push rod path (FIG. 4), the face 19 of the push rod 17 does not lie adjacent to the pre-tensioned spring 14, but that there remains a certain distance between them, this being termed the "free path."

Finally, FIG. 9 shows the position after the return jump of the jump member 6, it can be seen that the push rod can now return to its starting position of FIG. 4 with no further influence on the jump member.

FIG. 6 should, however, be considered once again. If, after the jump member has moved, the push rod is moved immediately in the opposite direction, which is quite usual in certain switching procedures, then the pre-tensioned spring 14 is already in a position in which the return action can be effected immediately in exactly the same manner, as explained above with reference to FIG. 8. Likewise, it is possible, as indicated in FIG. 7, to allow the push rod to "lag behind" in the desired manner, in order to obtain the usually prescribed full connection path.

We claim:

1. An electric snap action switch comprising:

a housing, a push rod slidable on the housing to be operated for movement in one direction and provided with a spring return, a jump member on the housing and mounting a contact unit to effect the electric switching, the jump member moving in the direction of the push rod, the jump member and push rod having confronting abutment faces spaced apart to permit movement of the jump member relative to the push rod and to induce movement of the jump member in both directions, the jump member having a pair of magnetic plates confronting each other, and the jump member also having a third plate adjacent one of said magnetic plates and spaced therefrom in the direction of sliding movement of the jump member, a single stationary retention magnet on the housing and located between and in spaced relation with the magnetic plates of the jump member to attract and alternately engage said adjacent magnetic plates, a single pre-tensioned compression bias spring oriented endwise of the direction of movement of the rod and having its ends seated on and between the third plate and the adjacent magnetic plate of the jump member, and the push rod also having spaced spring seats confronting each other adjacent the jump member, the seats also confronting the ends of the compression spring for alternately bearing against and compressing the opposite ends of the spring when the rod is moved in opposite directions to produce accelerated movement of the jump member and contact unit in both directions.

2. A switch according to claim 1, and the jump member having means mounting the magnetic plate adjacent the third plate for limited movement on the jump member toward and away from said third plate.

3. A switch according to claim 1 and the pre-tensioned spring braces itself through a thrust piece against the one magnetic plate and lies in one axis with the retention magnet.

4. A switch according to claim 2, wherein the jump member consists of a "U" shaped bracket, the limbs of which form one of the magnetic plates, the pre-tensioned spring acts against the limb of the bracket, directly or indirectly, that the free ends of the limb are located in the contact unit of electrically insulating material, and that the bracket and the contact unit have recesses aligned together for guiding the one magnetic plate.

5. A switch according to claim 6, characterised in that the pre-tensioned spring acts through a thrust piece guided between the base of the bracket and the face of the contact unit lying opposite to the latter.

6. A switch according to claim 1 wherein the spring return includes springs arranged at the sides of the jump member.

7. The snap action switch according to claim 1 and the spacings of the spring seats relative to the spring and of the rod and jump member abutment faces being located to sequence the push rod in both directions to first engage and then compress the bias spring prior to engaging the jump member for separating the magnetic plate from the magnet.

8. The snap action switch according to claim 1 and said magnet having permanent magnetism.

9. The snap action switch according to claim 1 wherein the spacing between the spring seats on the push rod is in excess of the normal length of the bias spring between the plates of the jump member.

* * * * *